US005578778A

United States Patent [19]

Imaizumi

[11] Patent Number: 5,578,778

[45] Date of Patent: Nov. 26, 1996

[54] ELECTRONIC MUSICAL INSTRUMENT

[75] Inventor: Tsutomu Imaizumi, Hamamatsu, Japan

[73] Assignee: Yamaha Corporation, Japan

[21] Appl. No.: 442,316

[22] Filed: May 16, 1995

[30] Foreign Application Priority Data

May 23, 1994 [JP] Japan ..... 6-132620

[51] Int. Cl.[6] ..... G10H 1/18; G10H 7/00

[52] U.S. Cl. ..... 84/615; 84/601

[58] Field of Search ..... 84/601, 602, 615, 84/653

[56] References Cited

U.S. PATENT DOCUMENTS

| | | | |
|---|---|---|---|
| 4,483,231 | 11/1984 | Hirano | 84/601 |
| 5,276,273 | 1/1994 | Takauji | 84/615 |
| 5,288,941 | 2/1994 | Sekizuka | 84/615 |
| 5,317,947 | 6/1994 | Miyata | 84/615 |
| 5,461,192 | 10/1995 | Imaizumi | 84/610 X |

FOREIGN PATENT DOCUMENTS 5-2394 1/1995 Japan .

*Primary Examiner*—William M. Shoop, Jr.
*Assistant Examiner*—Jeffrey W. Donels
*Attorney, Agent, or Firm*—Graham & James LLP

[57] ABSTRACT

An electronic musical instrument comprises a panel memory for storing panel setting data for controlling the present operation of the electronic musical instrument, panel switches for changing the values of the data stored in the panel memory, and registration memories for storing the data changed by the panel switches. A YES switch of the panel switches is provided to designate part of the panel setting data, and registration memory-designating switches to instruct to load the data stored in the registration memories into the panel memory. A CPU selectively reads out data other than the part of data designated by the YES switch, from among the panel setting data stored in a selected one of the second memory, based on the command issued by the registration memory-designating switches, and rewrites corresponding data stored in the panel memory by the data read out. A cursor switch is operated to change the range of the part of data designated by the YES switch.

5 Claims, 8 Drawing Sheets

FIG.6

FREEZE FLAG TABLE FFT

| |
|---|
| FF( 1 ) |
| FF( 2 ) |
| FF( 3 ) |
| FF( 4 ) |
| ⋮ |
| FF( N ) |

ELECTRONIC MUSICAL INSTRUMENT

BACKGROUND OF THE INVENTION

1. Field of the Invention

This invention relates to an electronic musical instrument which has a so-called registration function, i.e. a function of storing a panel setting state into a memory and reading out the panel setting state therefrom to change the panel setting state.

2. Prior Art

There have been conventionally known electronic musical instruments which have a panel memory for storing a set of control information for controlling the current operation of the electronic musical instrument, i.e. present panel setting (setting of a plurality of switches provided on the surface of an operation panel) for tone color, volume, effects, style, tempo, etc., and a registration memory (preset memory) for storing a plurality of sets of control information, and wherein one set of control information is read out from the registration memory to rewrite contents of the panel setting data stored in the panel memory by the data read out from the registration memory (registration function), to thereby enable controlling the electronic musical instrument according to the user's choice.

These conventional electronic musical instruments include one, for example, proposed by Japanese Laid-Open Patent Publication (Kokai) No. 5-2394, which can permit the user to instruct to inhibit (freeze) rewriting part of the panel setting data (e.g. tone color information) stored in the panel memory by panel setting data read out from the registration memory in rewriting the panel memory by using the registration function.

According to the conventional musical instrument, however, rewrite-inhibition can be applied only to a predetermined part of the panel setting data. As a result, the user cannot freely select desired panel setting data to inhibit rewriting thereof. Therefore, the user can find very limited occasions to use the rewrite-inhibition function (freeze function).

SUMMARY OF THE INVENTION

It is the object of the invention to provide an electronic musical instrument which is capable of affording more opportunities of using the freeze function.

To attain the object, the present invention provides an electronic musical instrument comprising:

first memory means for storing plural kinds of data for controlling present operation of the electronic musical instrument;

changing means for changing values of the plural kinds of data stored in the first memory means;

second memory means for storing plural kinds of data;

data-designating means for designating part of the plural kinds of data;

instructing means for instructing to load at least part of the plural kinds of data stored in the second memory means into the first memory means;

rewriting means for selectively reading out data other than the part of the plural kinds of data designated by the data-designating means, from among the plural kinds of data stored in the second memory means, in response to an instruction from the instructing means, and for rewriting corresponding data stored in the first memory means by the data read out; and range-changing means for changing a range of the part of the plural kinds of data to be designated by the data-designating means.

Preferably, the range-changing means determines the range of the part of the plural kinds of data by designating each data item of the plural kinds of data as the part of the plural kinds of data.

Alternatively, the range-changing means may determine the range of the part of the plural kinds of data by designating a plurality of groups from among the plural kinds of data as the part of the plural kinds of data.

Also alternatively, the range-changing means may determine the range of the part of the plural kinds of data by designating first one and last one of the plural kinds of data.

Preferably, the second memory means comprises a plurality of memories, the electronic musical instrument including memory-designating means for designating one of the plurality of memories into which the plural kinds of data, values of which has been changed by the changing means, are to be stored.

The above and other objects, features, and advantages of the invention will be more apparent from the following detailed description taken in conjunction with the accompanying drawings.

BRIEF DESCRIPTION OF THE DRAWINGS

FIG. 6 shows a memory map of a freeze flag table FFT: and

DETAILED DESCRIPTION

The invention will now be described in detail with reference to the drawings showing an embodiment thereof.

Figure 1:
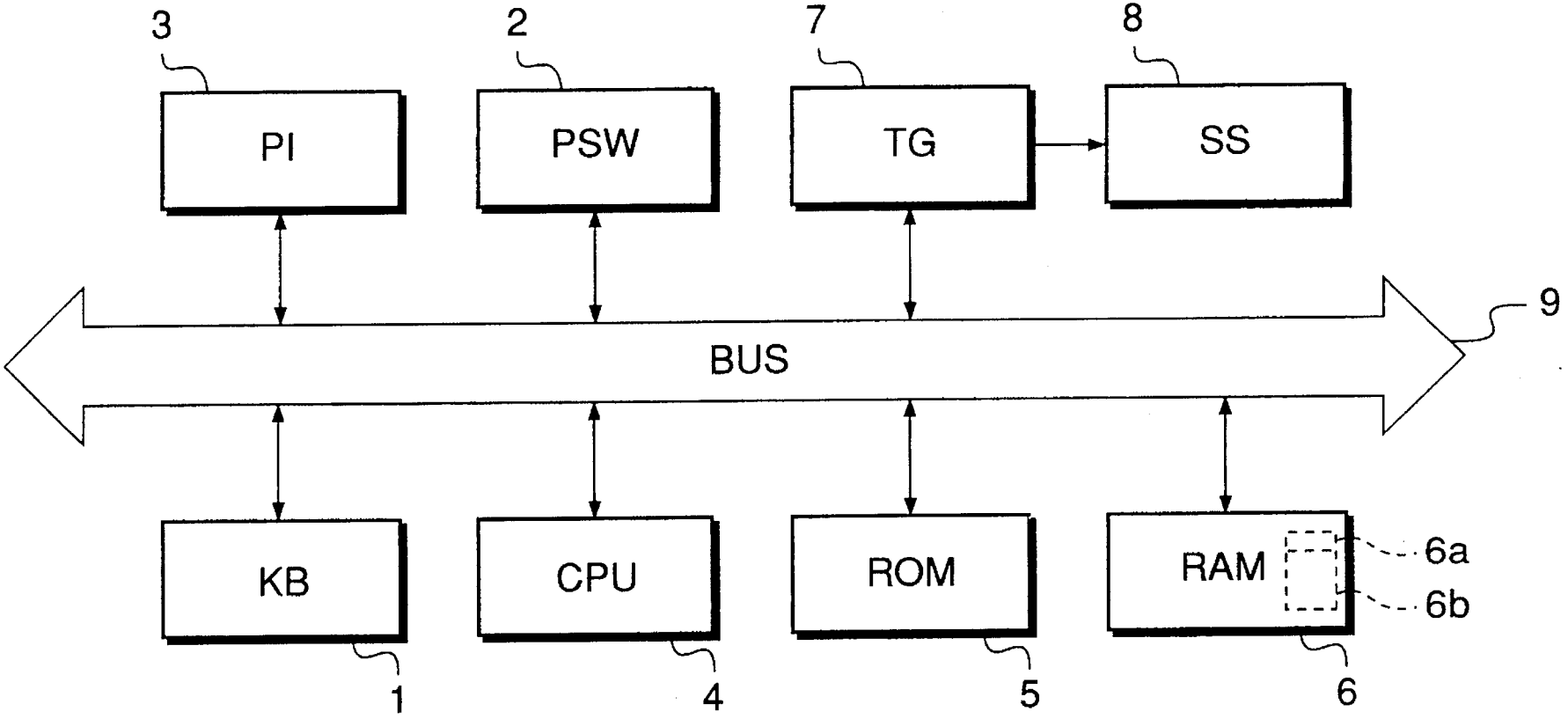
FIG. 1 is a block diagram schematically showing the arrangement of an electronic musical instrument according to an embodiment of the invention.

Referring first to FIG. 1, there is schematically illustrated the whole arrangement of an electronic musical instrument according to an embodiment of the invention.

As shown in the figure, the electronic musical instrument according to the embodiment is comprised of a keyboard (KB) 1 for inputting tone pitch information, panel switches (PSW) 2 for inputting various kinds of panel information, a panel display 3 (PI) for displaying an input state of the various panel information from the panel switches 2, etc., a CPU 4 for controlling the operation of the whole electronic musical instrument, a ROM 5 storing control programs to be executed by the CPU 4, table data, etc., a RAM 6 for temporarily storing results of calculations executed by the CPU 4, various input information from the panel switches 2, etc., a tone generator (TG) 7 for generating musical tone signals according to the tone pitch information input by the keyboard 1, etc., and a sound system (SS) 8 formed of a loudspeaker or loudspeakers, etc., for converting the musical tone signals from the tone generator 7 to musical sound.

The above-mentioned component elements 1 to 7 are connected to each other through a bus 9. The tone generator 7 is connected to the sound system 8.

A panel memory area 6*a* and registration memory areas (four in the present embodiment) 6*b* are provided in the RAM 6. When panel setting is carried out by the operation of one or more of the panel switches 2, the panel setting data are temporarily stored into the panel memory area. Further, the thus stored panel setting data are also stored into a selected one of the registration memory areas as registration data, and read out and set into the panel memory area, in a manner described hereinafter.

Figure 1A:
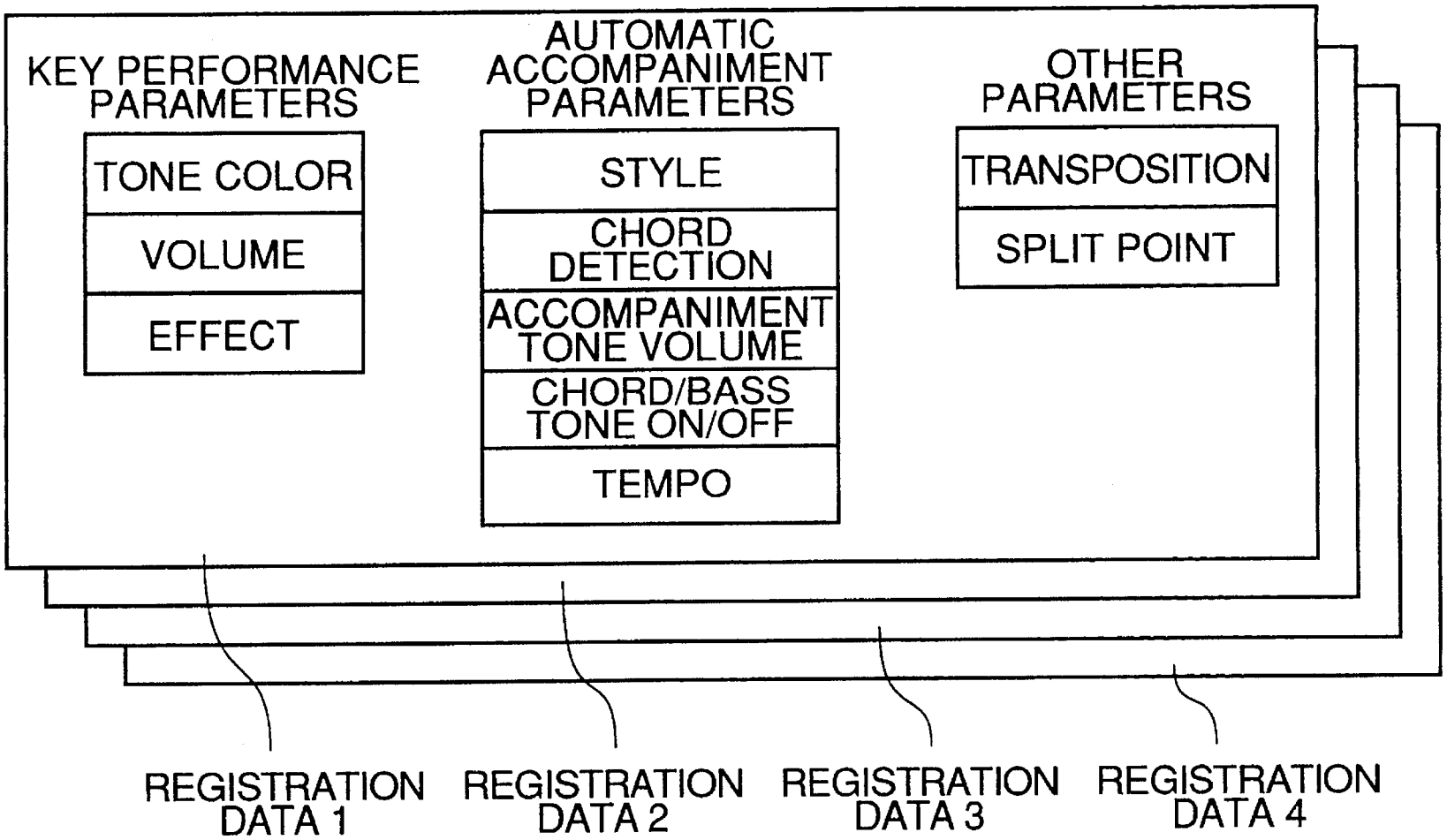
FIG. 1A shows a memory map of one of registration memory areas provided in a RAM appearing in FIG. 1.

FIG. 1A shows the memory map of registration data stored in the registration memory areas 6*b* of the RAM 6. The registration data are comprised of four sets of registration data 1 to 4 which are stored in respective ones of the registration memory areas 6*b* of the RAM 6. Each registration data forms a set of control information and is formed of key performance parameters consisting of tone color, volume, and effect, automatic accompaniment parameters consisting of style, chord detection method (SF, FC), accompaniment tone volume, chord/bass tone ON/OFF, and tempo, and other parameters consisting of transposition, and split point.

Also the panel setting data stored in the panel memory area 6*a* of the RAM 6 has the same map construction, and its illustration is therefore omitted.

Figure 2:
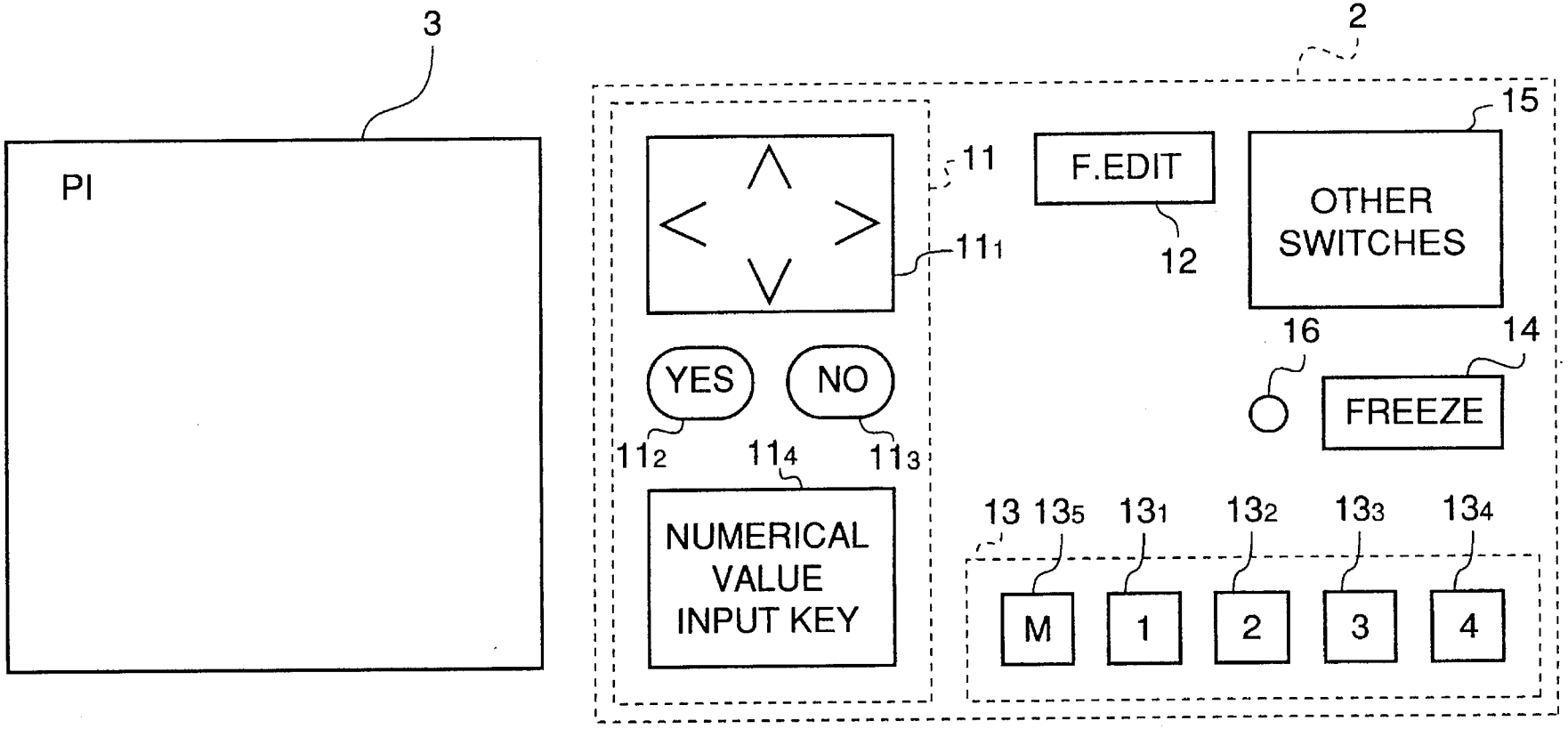
FIG. 2 is a diagram schematically showing the arrangement of a panel surface of the electronic musical instrument appearing in FIG. 1.

FIG. 2 schematically shows the arrangement of a panel surface of the electronic musical instrument according to the embodiment. The panel surface is comprised of the panel switches 2 and the panel display 3.

In the figure, the panel switches 2 are comprised of a display switch (DSW) 11, i.e. a switch group which perform settings related to a screen display of the panel display (PI) 3, e.g. for freeze setting described hereinafter, a freeze-setting switch (F.EDIT) 12 for instructing to set a freeze setting mode in which rewrite inhibiting (freezing) items can be set, a registration switch 13 for instructing to store or read out the panel setting data, a freeze switch (FREEZE) 14 for instructing to carry out a freeze function, and other switches 15. Arranged in the vicinity of the freeze switch 14 is an LED 16 for indicating as to whether or not the freeze function is being carried out.

The display switch 11 is comprised of a cursor switch $\mathbf{11}_1$ for vertically and horizontally shift a cursor displayed on the panel display 3, a YES switch $\mathbf{11}_2$ for setting a rewrite freezing mode in which panel setting data (parameter), at which the cursor switch $\mathbf{11}_1$ is located, is inhibited from being rewritten, a NO switch $\mathbf{11}_3$ for setting a rewritable mode in which panel setting data (parameter) at which the cursor switch $\mathbf{11}_1$ is located, is allowed to be rewritten, and a numerical value-inputting key $\mathbf{11}_4$ for inputting numerical values.

The registration switch 13 is comprised of registration memory-designating switches $\mathbf{13}_1$ to $\mathbf{13}_4$ corresponding, respectively, to the four registration memories (registration memory areas 6*b*), and a memory switch (M) $\mathbf{13}_5$ for instructing to selectively store the panel setting data into the registration memories. By pressing one of the registration memory-designating switches $\mathbf{13}_1$ to $\mathbf{13}_4$ with the memory switch $\mathbf{13}_5$ being held down, the present panel setting state is stored into the registration memory corresponding to the pressed registration memory-designating switch.

The control operation carried out by the CPU 4 of the electronic musical instrument constructed as above will be described below with reference to FIGS. 3 to 7.

Figure 3:
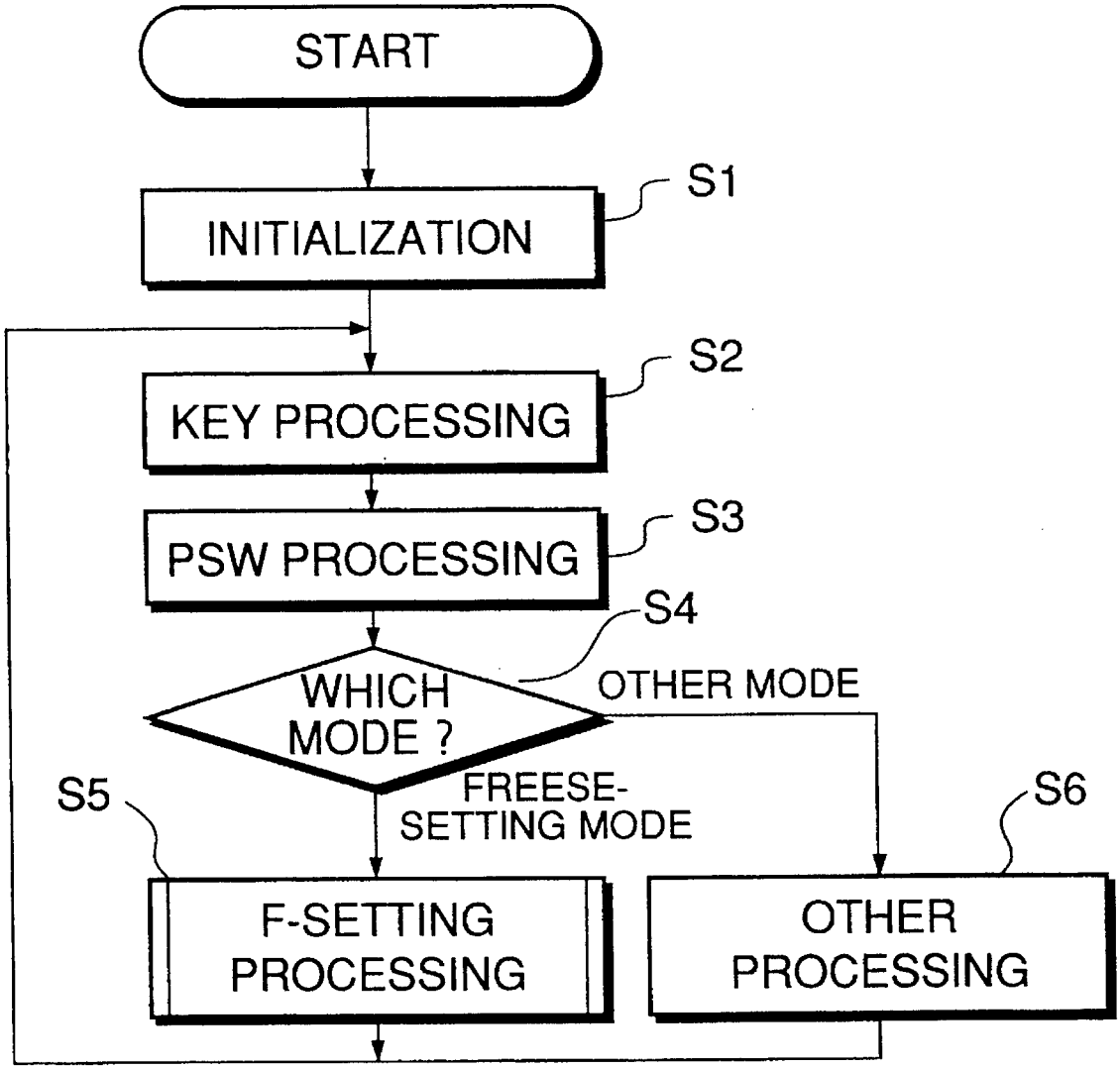
FIG. 3 is a flowchart showing a main routine carried out by the present embodiment.

FIG. 3 shows a main routine carried out by the present embodiment.

First, at a step S1, initializations of the CPU 4, the RAM 6, etc. are executed.

Then, at a step S2, key processing is carried out, such as detection of key operation upon depression of a key of the keyboard 1, and tone generation according to the detected key operation, and at a step S3, panel switch (PSW) processing is carried out, which detects the operating state of the panel switch (PSW) 2. Then, it is determined at a step S4 whether the electronic musical instrument is in the freeze-setting mode or in another mode.

If it is determined at the step S4 that the instrument is in the freeze-setting mode, a subroutine of freeze (F)-setting processing is executed at a step S5, followed by the program returning to the step S2 to repeatedly execute the above processing. On the other hand, if the instrument is in another mode, another processing is carried out at a step S6, followed by the program returning to the step S2 to repeatedly execute the above processing.

Figure 4:
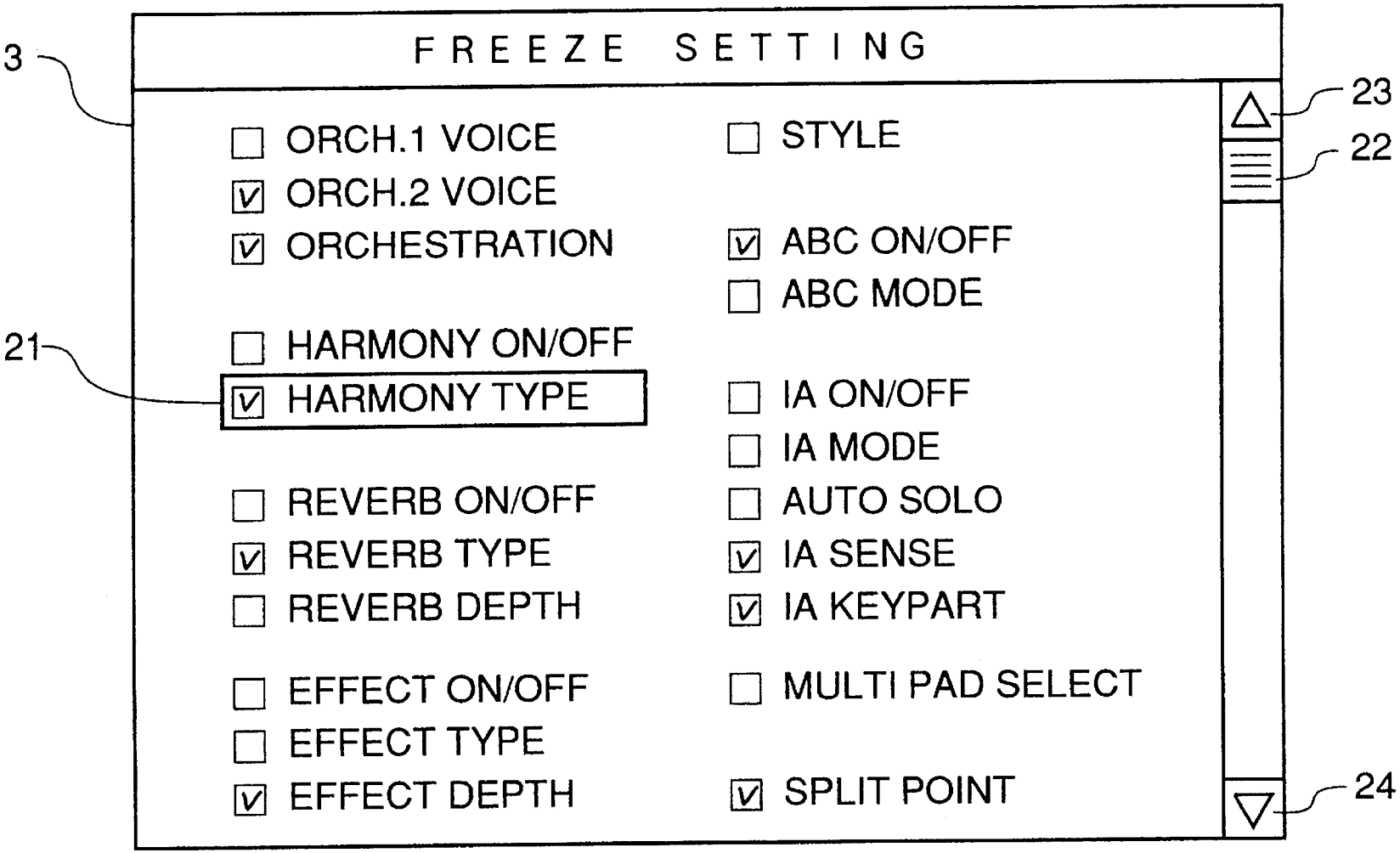
FIG. 4 is a diagram showing, by way of example, a view displayed on a panel display in FIG. 2 in freeze-setting mode.

FIG. 4 shows, by way of example, a view displayed on the panel display 3 in FIG. 2 in the freeze-setting mode.

In the figure, panel setting data (parameters) of which "freeze" can be set are displayed by way of example. By moving the cursor 21 to the location of a desired parameter by the cursor switch $\mathbf{11}_1$ and then pressing either the YES switch $\mathbf{11}_2$ or the NO switch $\mathbf{11}_3$, freeze setting or freeze canceling of the desired parameter can be carried out. The panel setting data includes, for example, selection of orchestra 1 voice (ORCH.1 VOICE), selection of orchestra 2 voice (ORCH.2 VOICE), ON/OFF control of orchestration (ORCHESTRATION), etc. In the figure, it is seen that the cursor 21 is pointed to harmony type (HARMONY TYPE).

Only part of the panel setting data of which freeze setting is possible is shown in FIG. 4. By moving the cursor switch $\mathbf{11}_1$ upward or downward, parameters at locations upper or lower than the highest or lowest location on the screen, which are not presently displayed on the screen, are successively displayed with simultaneous movement of a scroll bar 22. Alternatively, parameters which are not displayed on the screen can be successively displayed by clicking an up scroll arrow 23 or a down scroll arrow 24.

Figure 5:
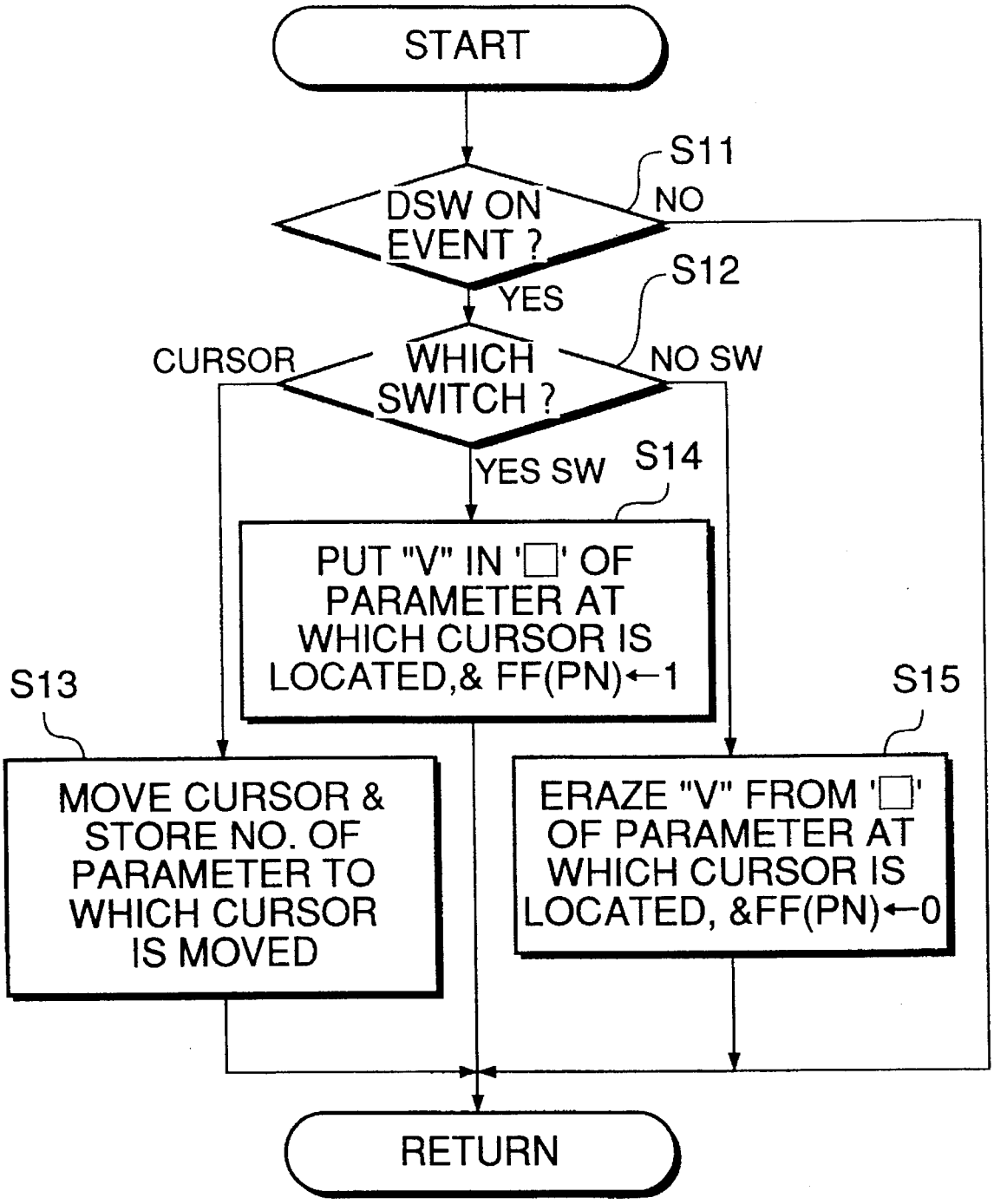
FIG. 5 is a flowchart showing details of a subroutine for carrying out a freeze-setting processing executed at a step S5 in FIG. 3.

FIG. 5 shows details of the subroutine for carrying out the freeze-setting processing executed at the step S5 in FIG. 3.

First, it is determined at a step S11 whether or not an on event of any switch of the display switch 11 has occurred. If no on event is detected, the program is immediately terminated. On the other hand, if an on event of any switch of the switch 11 is detected, it is determined at a step S12 at which switch the on event is detected.

If it is determined at the step S12 that the cursor switch $\mathbf{11}_1$ has been pressed, the cursor 21 is moved in the direction indicated by the cursor switch $\mathbf{11}_1$ pressed, and the number of the parameter to which the cursor 21 is moved is stored into an area PN preset in the RAM 6, at a step S13, followed by terminating the present subroutine. In this connection, predetermined numbers are allotted, respectively, to the panel setting parameters including those displayed on the panel display 3 in FIG. 4, and the number allotted to each parameter is stored into the area PN. The contents of the area PN will be hereinafter referred to as the parameter number PN.

If it is determined at the step S12 that the YES switch $\mathbf{11}_2$ has been pressed, a mark "V" indicating that freeze setting has been made is put in a box "□" before the parameter, at which the cursor 21 is located, as shown in FIG. 4, and at the same time a freeze flag FF(PN) indicated by the parameter number PN is set to "1", at a step S14, followed by terminating the present subroutine.

Further, if it is determined at the step S12 that the NO switch $\mathbf{11}_3$ has been pressed, the mark "V" in the box "□" before the parameter, at which the cursor 21 is located, is erased and at the same time the freeze flag FF(PN) indicated by the parameter number PN is reset to "0", at a step S15, followed by terminating the present subroutine.

FIG. 6 shows a freeze flag table FFT, and an area for storing the freeze flag table FFT is preset in the RAM 6. As is learned from the figure, a freeze flag FF is provided for each of the parameters, and it is determined whether or not the parameter is to be frozen, from the set value of the corresponding flag, as described hereinafter.

Figure 7:
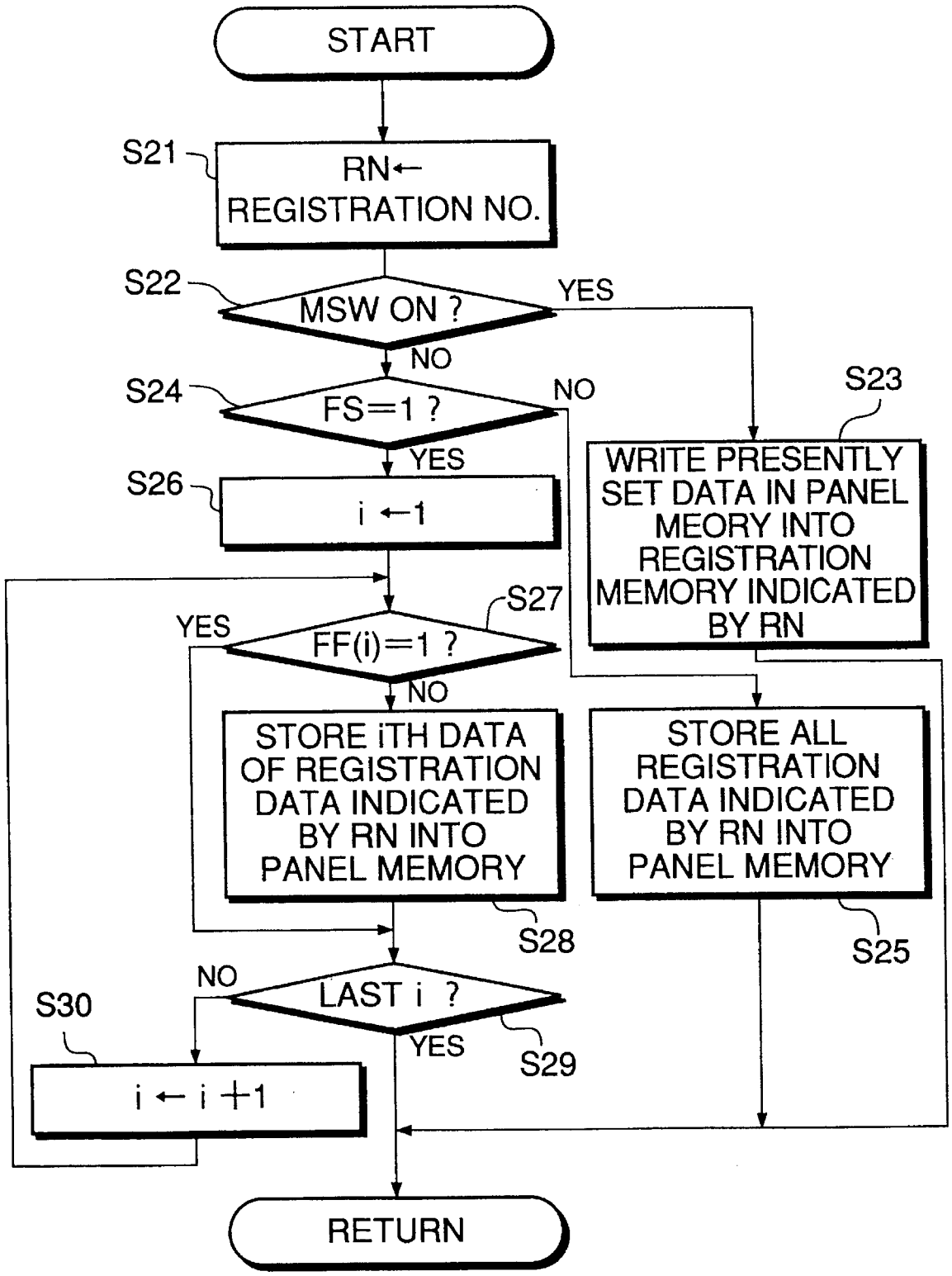
FIG. 7 is a flowchart showing details of a subroutine for carrying out a registration switch-on event executed as one of other processings at a step S6 in FIG. 3.

FIG. 7 shows details of a subroutine for carrying out a registration switch-on event executed as another processing at the step S6 in FIG. 3, which is executed when any of the switches $\mathbf{13}_1$ to $\mathbf{13}_4$ of the registration switch 13 has been pressed.

First, the number corresponding to the switch pressed out of the registration memory-designating switches $\mathbf{13}_1$ to $\mathbf{13}_4$ is stored into an area RN preset in the RAM 6 at a step S21. In this connection, predetermined numbers are allotted, respectively, to the registration memory-designating switches $\mathbf{13}_1$ to $\mathbf{13}_4$, and the number allotted to the switch pressed is stored into the area RN.

Next, it is determined at a step S22 whether or not the memory switch (MSW) $\mathbf{13}_5$ is held down. If the MSW $\mathbf{13}_5$ is held down, the panel setting data presently set are written into the registration memory area indicated by the number stored in the the area RN at a step S23, followed by terminating the present subroutine. More specifically, as stated before, when one of the registration memory-designating switches $\mathbf{13}_1$ to $\mathbf{13}_4$ is pressed with the memory switch $\mathbf{13}_5$ being held down, the presently set panel setting data are stored into the corresponding registration memory area.

On the other hand, if it is determined at the step S22 that the memory switch $\mathbf{13}_5$ is not held down, which means that only one of the registration memory-designating switches $\mathbf{13}_1$ to $\mathbf{13}_4$ has been pressed, the program proceeds to a step S24, wherein it is determined whether or not the freeze switch FREEZE 14 has been pressed, from the value of a freeze function-setting flag FS. The freeze function-setting flag FS indicates whether or not the freeze function is selected, the value of which is also stored into an area preset in the RAM 6. In this connection, if the freeze switch (FREEZE) 14 is pressed while the freeze function-setting flag FS assumes "0", i.e. while the freeze function is not selected, the freeze function-setting flag FS is set to "1". On the other hand, if the freeze switch (FREEZE) 14 is pressed while the freeze function-setting flag FS assumes "1", i.e. while the freeze function is selected, the freeze function-setting flag FS is reset to "0". Responsive to the set value of the flag FS, the LED 16 is controlled to be lighted on and off.

If it is determined at the step S24 that the freeze function-setting flag FS is set to "0", which means that the freeze function is not selected, all the registration data, i.e. panel setting data, stored in the registration memory area indicated by the number stored in the area RN are read out and stored into the panel memory *6a* at a step S25, followed by terminating the present subroutine.

On the other hand, if the freeze function-setting flag FS is set to "1", a soft counter i preset in the RAM 6 is initialized (i=1) at a step S26. The soft counter i is used to retrieve the set states of all the freeze flags FF(i) in the freeze flag table FFT, and counts up to the number of the freeze flags FF( ). More specifically, in the present embodiment, the counter i counts from 1 to N, as shown in FIG. 6.

At the following step S27, the value of the freeze flag FF(i) indicated by the counter i is determined, and if the value of the freeze flag FF(i) is "0", i.e. if the parameter of the registration data corresponding to the freeze flag FF(i) indicated by the number stored in the area RN is not to be frozen, the parameter is stored into the panel memory *6b* at a step S28. On the other hand, if the value of the freeze flag FF(i) is "1", i.e. if the corresponding parameter is to be frozen, the program skips over the step S28 to a step S29.

At the step S29, it is determined whether or not the counter i has counted up the whole range to be counted. If the answer is affirmative (YES), the present subroutine is terminated. On the other hand, if the answer is negative (NO), the count value of the counter i is incremented by "1" at a step S30, and then the program returns to the step S27 to repeatedly execute the above processing.

As described hereinabove, according to the present embodiment, each of the parameters of the registration data is subjected to determination as to whether or not the parameter is to be frozen. Therefore, the parameters can be set as desired by the user, and hence opportunities of performing the freeze function can be increased.

The present embodiment is thus constructed such that each of the parameters of the registration data is subjected to determination as to whether or not the parameter is to be frozen, but this is not limitative. Alternatively, the parameters may be classified into a plurality of groups each consisting of a plurality of parameters, and each of the groups may be determined as to whether or not the group of parameters is to be frozen. In such an alternative case, only one freeze flag FF is required for each group.

Further, according to the present embodiment, each parameter is designated by the cursor to determine whether or not freezing thereof is to be effected. Alternatively, first and last parameters of registration data may be designated and parameters within a range defined by the first and last parameters may be collectively determined as to whether or not freezing thereof is to be effected. In such an alternative case, the designation of the range may be carried out not only by the cursor but also by another input device, such as a mouse.

Still further, the present embodiment is constructed such that a plurality of registration memories and a single freeze flag table FFT are preset in separate areas within the RAM 6, and writing of each parameter of registration data read from each of the registration memories into a panel memory is controlled depending upon the set value of a flag of the freeze flag table FFT corresponding to the parameter, but this is not limitative. Alternatively, not only panel setting data but also freeze-setting information, i.e. information on the range of parameters to be frozen, etc. may be stored together into the registration memories. In such an alternative case, whenever each parameter of the panel setting data is read from the registration memory, the range of parameters to be frozen, etc. is changed.

Moreover, according to the present embodiment, the whole panel setting data are used as the registration data. However, the registration data may be limited to part of the panel setting data, such as voice data, automatic accompaniment data, and automatic performance data.

What is claimed is:

1. An electronic musical instrument comprising:

first memory means for storing plural kinds of data for controlling present operation of said electronic musical instrument;

changing means for changing values of said plural kinds of data stored in said first memory means;

second memory means for storing plural kinds of data;

data-designating means for designating part of said plural kinds of data;

instructing means for instructing to load at least part of said plural kinds of data stored in said second memory means into said first memory means;

rewriting means for selectively reading out data other than said part of said plural kinds of data designated by said data-designating means, from among said plural kinds of data stored in said second memory means, in response to an instruction from said instructing means, and for rewriting corresponding data stored in said first memory means by said data read out; and range-changing means for changing a range of said part of said plural kinds of data to be designated by said data-designating means.

2. An electronic musical instrument as claimed in claim 1, wherein said range-changing means determines said range of said part of said plural kinds of data by designating each data item of said plural kinds of data as said part of said plural kinds of data.

3. An electronic musical instrument as claimed in claim 1, wherein said range-changing means determines said range of said part of said plural kinds of data by designating a plurality of groups from among said plural kinds of data as said part of said plural kinds of data.

4. An electronic musical instrument as claimed in claim 1, wherein said range-changing means determines said range of said part of said plural kinds of data by designating first one and last one of said plural kinds of data as said part of said plural kinds of data.

5. An electronic musical instrument as claimed in claim 1, wherein said second memory means comprises a plurality of memories, said electronic musical instrument including memory-designating means for designating one of said plurality of memories into which said plural kinds of data, values of which has been changed by said changing means, are to be stored.

* * * * *